US005369938A

United States Patent [19]

Panveno et al.

[11] Patent Number: 5,369,938

[45] Date of Patent: Dec. 6, 1994

[54] PROCESS FOR MAKING ONE-PIECE BOXES

[75] Inventors: Michael Panveno, Winfield; Dean Henkel, Carol Stream, both of Ill.

[73] Assignee: AGI Inc., Melrose Park, Ill.

[21] Appl. No.: 9,823

[22] Filed: Jan. 27, 1993

[51] Int. Cl.[5] ..... B65B 43/10; B31B 15/02; B31B 3/26

[52] U.S. Cl. ..... 53/456; 493/10; 493/54; 493/110; 493/111; 229/923; 229/103.2; 229/116.1

[58] Field of Search ..... 493/53, 54, 110, 111, 493/906, 10; 229/40, 923; 53/456

[56] References Cited

U.S. PATENT DOCUMENTS

| | | | |
|---|---|---|---|
| 1,827,442 | 10/1931 | Stokes | 229/923 |
| 1,851,518 | 3/1932 | McGovern | 493/111 |
| 1,865,159 | 6/1932 | Adamson | 493/111 |
| 2,015,202 | 9/1935 | Stokes | 493/110 |
| 2,111,157 | 3/1938 | Stokes | 493/110 |
| 4,608,038 | 8/1986 | Virta et al. | 493/29 |
| 5,108,355 | 4/1992 | Walsh | 493/89 |

OTHER PUBLICATIONS

Opcon Advertizement "Have Your Sensors Reached Their Limits?" Machine Design Oct. 1984.

*Primary Examiner*—William E. Terrell
*Attorney, Agent, or Firm*—Weil, Gotshal & Manges

[57] ABSTRACT

The present invention comprises a process for manufacturing a single piece multi-purpose box from a board blank and a wrap. The process includes using an in-line scanner to align a board blank with a printed wrap along pre-cut notches so that the board blank and wrap may be wrapped together and folded once aligned, without additional cutting and without leaving any rough edges along the spine. This improved process is faster, by removing the cutting step, and is cleaner, by leaving no rough edges, than the processes previously known in the art.

14 Claims, 2 Drawing Sheets

PROCESS FOR MAKING ONE-PIECE BOXES

BACKGROUND OF THE INVENTION

It is desirable to make boxes in a quick and efficient manner to manufacture them inexpensively. It is also desirable to make boxes with aesthetic appeal to entice customers to buy the product within the box.

It has been known in the art to make single piece boxes where the top and bottom of the box are one connected unit, see, e.g., U.S. Pat. Nos. 4,771,886 and 4,641,750. These boxes may only be made from materials that may be molded and require a separate step in which a label may be affixed to the boxes.

Processes are also known for forming single piece boxes from two pieces, a board blank and a wrap wherein the wrap primarily functions as a decoration and/or a label. Previously known processes of this type, however, require joining a board blank with a wrap and then cutting the joined pieces to form the spine of the box at the end of the process. Such processes leave rough edges on the spine of the box and involve an extra cutting step.

SUMMARY OF THE INVENTION

The present invention comprises a process for manufacturing a single piece multi-purpose box from a board blank and a wrap. The process includes using an in-line scanner to align a board blank with a printed wrap along pre-cut notches so that the board blank and wrap may be wrapped together and folded once aligned, without additional cutting and without leaving any rough edges along the spine. This improved process is faster, by removing the cutting step, and is cleaner, by leaving no rough edges, than the processes previously known in the art.

DETAILED DESCRIPTION OF THE INVENTION

Referring to the figures, the present invention involves a process wherein a board blank 1 and a wrap 2 are aligned, wrapped and bent to form a single-piece box 10. The board blank 1 and wrap 2 are formed so that they may be aligned by an in-line scanner to provide an efficient method of making single-piece boxes without rough edges and without an additional cutting step. Instead, after alignment the wrap needs only be wrapped around the blank and the joined pieces bent to form the box 10.

Figure 1:
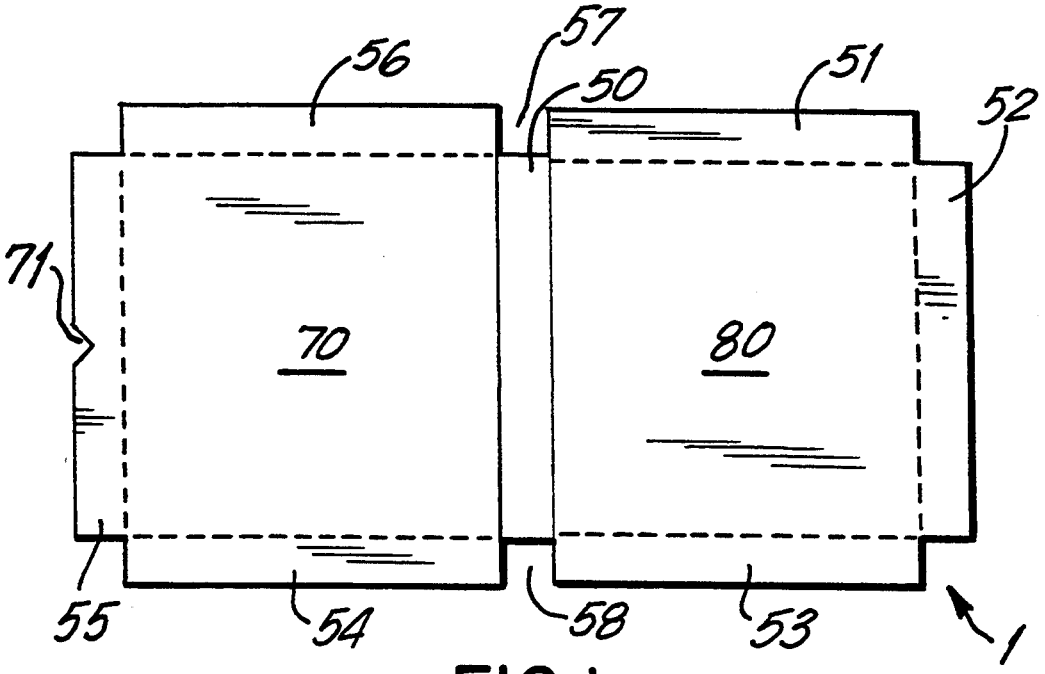
FIG. 1 is a plan view of a board blank according to the present invention.

A board blank for use in the present invention, shown in FIG. 1, comprises two rectangular regions 70, 80 which will ultimately form, respectively, the top and bottom surfaces of the box 10, an intermediate spine region 50, and six wall regions 51, 52, 53, 54, 55, 56 which will ultimately form the walls of the box 10. Wall regions 54, 55, 56 adjoin the top region 70 and regions 51, 52, 53 adjoin the bottom region 80. The boundary lines separating the wall regions 51–56 from the top and bottom regions 70, 80 are scored through about 70–80% of the thickness of the blank material, on the side of the blank that will form the exterior of the box, to facilitate bending of the wall regions approximately 90 degrees to an orientation perpendicular to the orientation of the bottom region 80 to form the walls of the box 10. The boundary lines between the spine region 50 and the top and bottom regions 70, 80 are channel scored at about a width of one-eighth of an inch.

The notches 57, 58 between the wall regions on either side of the spine region 50 and adjacent to the spine region 50 are of the same width as the spine region 50. These notches are the guides by which the board blank 1 and the wrap 2 will ultimately be aligned before assembly according to the present invention.

Since the top of the box, once assembled, nests over the bottom of the box, the top region 70 must be slightly larger in both dimensions than the bottom region 80. The width of the top region 70, measured, in the sense of the Figures, in a vertical direction, must be at least one thickness of the board blank material and two thicknesses of the wrap material wider than the bottom region 80. The length of the top region 70, measured, in the sense of the Figures, in a horizontal direction, must be at least two thicknesses of the board blank and four thicknesses of the wrap material longer than the bottom region 80. The length of the spine region 50, measured, in the sense of the Figures, in a horizontal direction, is equal in length to the top region 70.

The length of the wall regions 51, 53 measured, in the sense of the Figures, in a vertical direction, is equal to the width of the bottom region 80 and have a width measured, in the sense of the Figures, in a horizontal direction, is equal to the width of the spine region 50 minus the thickness of the board blank 1 material.

The length of the wall region 52 measured, in the sense of the Figures, in a horizontal direction, is equal to the length of the bottom region 80 and the width of the wall region 52, measured, in the sense of the Figures, in a vertical direction, is equal to the width of the wall regions 51, 53.

The length of the wall regions 54, 56, measured, in the sense of the Figures, in a vertical direction, is equal to the width of the top region 70 and has a width measured, in the sense of the Figures, in a horizontal direction, equal to the width of the wall regions 51, 53. The length of the wall region 55 measured, in the sense of the Figures, in a horizontal direction, is equal to the length of the top region 70. The width of the wall region 55, measured, in the sense of the Figures, in a vertical direction, equal to the width of the wall regions 54, 56.

One may optionally form a shape such as a v-cut 71 in the wall region 55 that lies alongside the top region 70, so that upon formation of the box 10 there is a notch with which to open the box. The shape 71 should be formed along the edge of the wall region 55 distant from the top region 70. It is preferred to put the cut in the wrap as well as the board, so that the cut may be covered by the wrap as part of the formation procedure, but one can alternately put such a cut in the wall 55 alongside the top region 70 after the box 10 is formed. However, such cuts after the wrap is wrapped onto the board blank leave rough edges, which are to be avoided.

The board blank 1 may be formed so that upon creation it has its three-dimensional shape, i.e., in a plastic mold. More commonly, the board blank 1 is formed from a flat piece of material that is die-cut, with the necessary cuts and channels in the material as described before. The wall regions 51-56 of the board blank 1 are bent along the boundary line between the wall regions 51-56 and the top and bottom regions 70,.80. They are bent away from the side in which the cuts were made to an orientation perpendicular to the orientation of the top and bottom regions 70, 80 and so that the wall regions 51, 53, 54, 56 are perpendicular to the orientation of the wall regions 52, 54. The juncture of the wall regions 51, 53 with the wall region 52 and the juncture of the wall regions 56, 54 with the wall region 55 forms the four corners 4 of the blank 1. These corners 4 are joined by appropriate means, e.g., gluing or taping, to secure the corners 4. A machine known in the art as a quad stayer, as is manufactured by Crathern & Smith, Inc. of Huntingdon Valley, PA. (Model QA-100), may be used to bend and tape the flat board blank 1. Said machine bends the wall regions 2, 3 of the flat board blank 1 perpendicular to the top and bottom regions 70, 80 and tapes the corners 4 formed by the juncture of the wall regions 51, 53 with the wall regions 52 and wall regions 54, 56 with the wall region 55.

The board blank 1 is made of a material that provides sufficient structural strength to the box. Additionally, if the blank is not preformed to the desired specifications, the material must be capable of being diecut from about 70% to about 80% of its thickness so as to be able to form the walls 6, 7 and the spine 5 of the box 10. Suitable materials for the board blank include plastics, cardstock, and cardboard, with 40 point clipboard being a preferred material.

Figure 2:
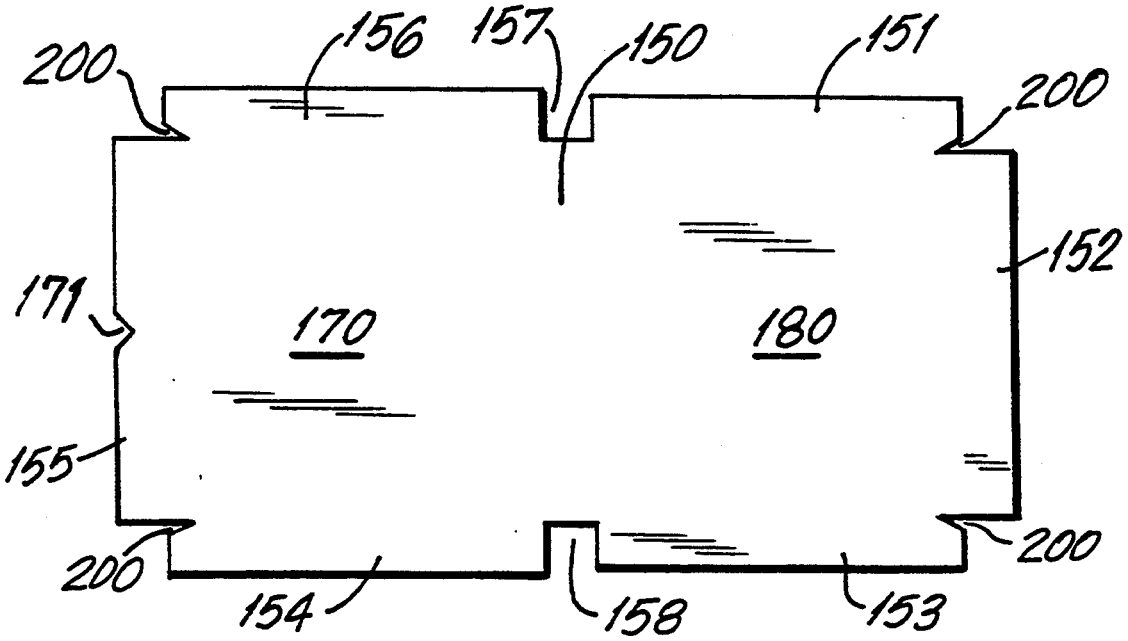
FIG. 2 is a plan view of a wrap according to the present invention.

A wrap 2 for use in the present invention, shown in FIG. 2, comprises two rectangular areas 170, 180, which will ultimately cover the top 70 and bottom 80 surfaces of the box 10, respectively, an intermediate spine region 150 between the top and bottom regions 170, 180, and six tabs 151, 152, 153, 154, 155, 156 which will ultimately cover the walls 51-56 of the box 10. These regions and areas have been designated for the purposes of describing the shape of the wrap 2 only and are not actual cuts in the wrap 2.

The spine region 150 is as long as the bottom region 180 and is the same width of the spine region 150 of the board blank 1. The top and bottom regions 170, 180 are slightly larger in size than the top and bottom regions 70, 80 of the board blank, respectively, to cover the edges of the board blank when the box is bent.

The notches 157, 158 between the tabs on either side of the spine region 150 and adjacent to the spine region 150 are of the same width as the spine region 150. These notches are the guides by which the board blank 1 and the wrap 2 will ultimately be aligned before assembly according to the present invention.

The length of the top region 170, measured, in the sense of the Figures, in a horizontal direction, must be as long as the top region 70. The length of the spine region 150, measured, in the sense of the Figures, in a horizontal direction, is equal to the length of the spine region 50. The width of the spine region 150, measured, in the sense of the Figures, in a vertical direction, is equal to the width of the spine region 50.

The length of the tab regions 151, 153 measured, in the sense of the Figures, in a vertical direction, is equal to the width of the bottom region 180 and they have a width measured, in the sense of the Figures, in a horizontal direction, that is greater than the width of the wall regions 150, 153.

The length of the tab region 152 measured, in the sense of the Figures, in a horizontal direction, is equal to the length of the bottom region 180 and the width of the tab 152, measured, in the sense of the Figures, in a vertical direction, is greater than the width of the wall region 52.

The length of the tabs 154, 156, measured, in the sense of the Figures, in a vertical direction, is equal to the width of the top region 170 and they have a width measured, in the sense of the Figures, in a horizontal direction, greater than the width of the wall regions 54, 56. The length of the wall region 155 measured, in the sense of the Figures, in a horizontal direction, is equal to the length of the top region 170. The width of the wall region 155, measured, in the sense of the Figures, in a vertical direction, is greater than the width of the wall region 55.

One may optionally form a shape such as a v-cut 171 in the tab 155 that lies alongside the top region 170, so that upon formation of the box 10 there is a notch with which to open the box.

A wrap may be cut to the desired specifications or may be directly formed to the desired specifications.

The tabs of the wrap 151, 153, 154, 156 may be cut 200 so as to prevent gapping of excess material of the wrap when the tabs 151, 152, 153, 154, 155, 156 are placed over the walls 51, 52, 53, 54, 55, 56 of the board blank 1. This may include cutting the tabs 151, 153, 153, 156 at their juncture 200 with the top or bottom regions 170, 180 to remove such excess material.

The wrap may be made from various materials including paper, fabrics and plastics which must be flexible and preferably should be strong enough to add structural strength to the box. The wrap may be printed or laminated on the side that will remain exposed after the box is formed to provide decoration or a label to the box.

Once the board blank 1 and the wrap 2 have been formed, an adhesive is placed on the non-laminated or nonprinted side of the wrap. This may be done mechanically by a machine known in the art as a gluer 21.

Figure 3:
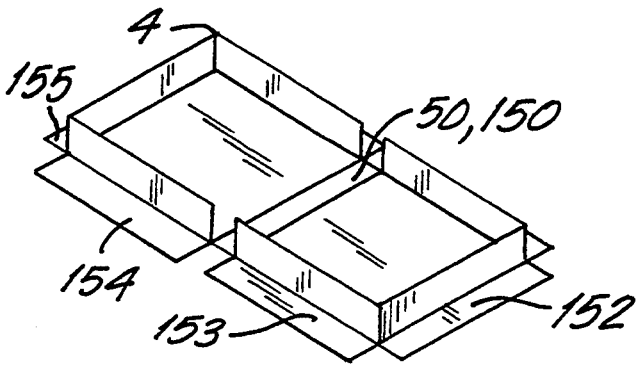
FIG. 3 is a perspective view of an aligned wrap and board blank, prior to the wrap being wrapped around the board blank.

After the adhesive is applied, the board blank 1 is placed on top of the wrap 2 with the top and bottom regions 70, 80 of the board blank 1 in contact with the top and bottom regions 170, 180 of the wrap 2, respectively, as depicted in FIG. 3. Matching the edges of the tabs 153, 154 and walls 53, 54 that form the boundary of the notches 58, 158 and the edges of the tabs 151, 156 with the edges of the walls 51, 56 that border the notches 57, 157 aligns the wrap 2 and board blank 1. These edges must run contiguously and one should be able to trace a straight line along all of these edges from the wrap 2 to the board blank 1. Additionally, the edges of the notches 157, 158 at the spine region 150 should be parallel and should be adjacent to the edges of the notches 57, 58 at the spine region 50. Once the notches 57, 157, 58, 158 are aligned, the top regions 70, 170 and bottom regions 80, 180 of the board blank 1 and wrap 2 will be aligned, respectively, as a consequence. Given that the size of the spine of the box may be relatively small, e.g., ¼", this alignment must be made with a small tolerance for error.

Prior to the present invention, the necessary tolerance had not been achieved. However, the addition of an in-line electronic eye scanner 23 to the process of uniting the wrap 2 and board blank 1 makes it possible to mechanically align the notches 57, 157, 58, 158 of the wrap and the board blank to a tolerance of up to five-millionths of an inch. If the alignment were not able to be accomplished, then the notches 57, 58, 157, 158 could only be cut after wrap 2 and the board blank 1 were joined and an extra step would be required. Scanners useful for the present invention are commercially available and are called "box spotters" in the art. An exemplary one is a Smith & Crathern spotter model RB-2A.

Figure 4:
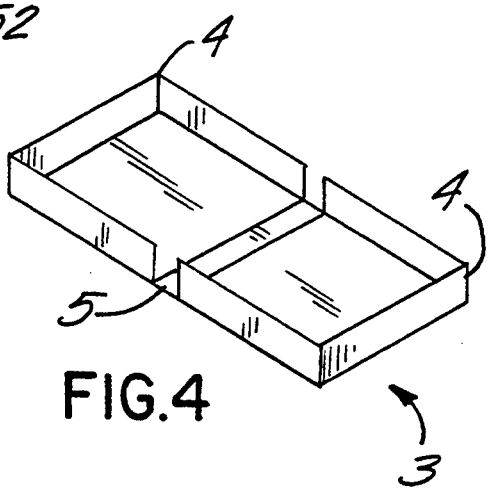
FIG. 4 illustrates a perspective view of an aligned wrap and board blank, after the wrap is wrapped around the board blank.
Figure 5:
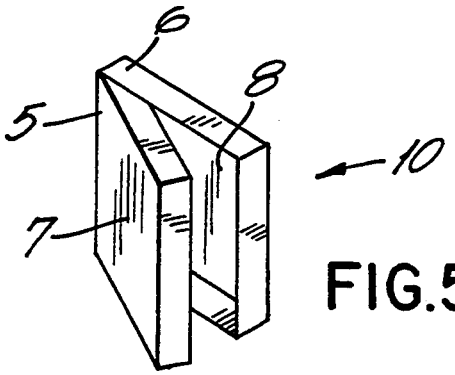
FIG. 5 illustrates a perspective view of an assembled single notched box of the present invention in an open position.

After alignment, the tabs 151, 152, 153, 154, 155, 156 of the wrap 2 are wrapped over the walls of the board blank 151, 152, 153, 154, 155, 156 to which they are adjacent, e.g., the tab 151 alongside the top region 170 of the wrap is wrapped over the wall 51 alongside the top region 70 of the board blank 1, and a seal is formed to keep the wrap on the board blank 1 as depicted in FIG. 4. This may be accomplished in a machine that is known in the art as a wrapper 24 as are made by Crather & Smith.

The wrapped blank 3 is then pressed along the united spines of 5 of the wrap 3 and board blank 1 to form a bend along the channelled boundary lines of the spine regions 5. The top region 7 and bottom region 8 are bent so that they are perpendicular in orientaion to the orientation of the spine region 5. The top and bottom regions 70, 170, 80, 180 of the united wrap and blank 3, become the top 7 and bottom 8 of the box 10, respectively, and the spine regions 50, 150 become the spine 5 of the box 10.

Figure 6:
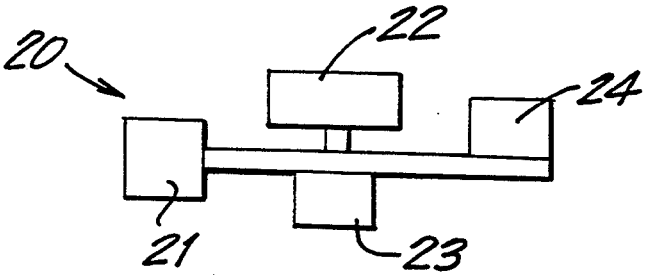
FIG. 6 is a schematic view of machinery to accomplish the formation of a box according to the present invention wherein a gluer, quad stayer, box spotter, and wrapper are used in an in-line process.

The quad stayer 22, gluer 21, spotter 23 and wrapper 24, may be aligned to provide a continuous method of making boxes of the current invention as depicted in FIG. 6.

There may then be additional steps added to the process to insert items into the box, such as compact disk trays and compact disks or to seal the box and its contents.

We claim:

1. A method for making a single-piece box, comprising:

(a) forming a board blank comprising (1) a rectangular spine region having long sides and short sides outlined by cuts made to a depth of about 70% to about 80% of the blank board material thickness along the long sides and by edges on the short sides, (2) two rectangular regions attached continuously along the long sides of the spine region, (3) walls attached continuously along the edges of the rectangular region not bounded by the spine region, so that there is a notch remaining next to the short sides of the spine region and attached such that walls meet at right angles to form four corners at the corners of the two rectangular regions not adjacent to the spine region;

(b) forming a wrap having an interior and exterior side comprising (1) a rectangular spine region having long sides and short sides, (2) two rectangular regions attached continuously along the long sides of the spine region, and (3) a tab adjacent to each edge of the rectangular regions not bounded by the spine region so that a notch remains adjacent to the short sides of the spine region;

(c) placing an adhesive on the interior of the wrap;

(d) aligning the wrap and the board blank using an electric eye scanner so that the board blank rests on the interior side of the wrap and the notches and the rectangular regions of the board blank and the wrap are aligned;

(e) wrapping the wrap around the board blank; and (f) bending the wrapped board blank along the cut edges of the spine region to form a box.

2. A method according to claim 1 wherein the wrap is comprised of paper.

3. A method according to claim 2 where the paper is printed on the exterior side.

4. A method according to claim 3 where the paper is laminated on the exterior side.

5. A method according to claim 1 where the board blank is comprised of cardboard.

6. A method according to claim 1 further comprising the additional step of inserting an item into the box.

7. A method according to claim 1 further comprising the additional step of closing the box.

8. A method for forming a single-pieced box, comprising:

(a) placing an adhesive on the interior side of a wrap comprising (1) a rectangular spine region having a long side and a short side, (2) two rectangular regions running continuously along the long sides of the spine region, and (3) a tab adjacent to each rectangular region on the edges not bounded by the spine region so that a notch remains adjacent to the short sides of the spine region;

(b) aligning said wrap and a board blank comprising placing the bard blank on the interior side of the wrap and aligning the notches of the wrap and board blank using an electric eye scanner, said board blank comprising (1) a rectangular spine region having a long side and a short side outlined by cuts made to a depth of a bout 70% to about 80% of the blank board material thickness along the long sides, (2) two rectangular regions running contiguously along the long sides of the spine region, (3) walls running along the edges of the rectangular region not bounded by the spine region, so that a notch remains adjacent to the short sides of the spine region;

(c) wrapping the wrap around the board blank; and (d) bending the spine of the wrapped board blank along the cut edges of the spine region so as to form a box.

9. A method according to claim 8 wherein the wrap is comprised of paper.

10. A method according to claim 9 where the paper is printed on the exterior side.

11. A method according to claim 10 where the paper is laminated on the exterior side.

12. A method according to claim 8 where the board blank is comprised of cardboard.

13. A method according to claim 8 further comprising the additional step of inserting an item into the box.

14. A method according to claim 8 further comprising the additional step of closing the box.

* * * * *